US007423536B2

(12) United States Patent
Young

(10) Patent No.: US 7,423,536 B2
(45) Date of Patent: Sep. 9, 2008

(54) HEAT SENSOR ACTIVATED DETECTOR AND METHOD

(76) Inventor: Edith B. Young, 1732 Westgate Ave., #2, Los Angeles, CA (US) 90025

( * ) Notice: Subject to any disclaimer, the term of this patent is extended or adjusted under 35 U.S.C. 154(b) by 166 days.

(21) Appl. No.: 11/255,285

(22) Filed: Oct. 22, 2005

(65) Prior Publication Data

US 2007/0008148 A1 Jan. 11, 2007

Related U.S. Application Data

(60) Provisional application No. 60/689,941, filed on Jun. 14, 2005.

(51) Int. Cl.
*G08B 23/00* (2006.01)

(52) U.S. Cl. ..... 340/573.1; 340/584; 340/586; 340/539.23; 340/686.1; 340/687; 73/61.46; 374/100; 600/549

(58) Field of Classification Search ..... 340/573.1, 340/573.4, 573.5, 581, 584, 586, 686.1, 539.23, 340/687; 374/132, 137, 100; 73/61.46; 600/549
See application file for complete search history.

(56) References Cited

U.S. PATENT DOCUMENTS 3,930,249 A * 12/1975 Steck et al. ..... 340/571
4,144,540 A 3/1979 Bottka ..... 357/30
4,763,112 A * 8/1988 Hsieh ..... 340/573.1
5,200,736 A * 4/1993 Coombs et al. ..... 340/586
5,230,563 A * 7/1993 Shalvi ..... 374/141
5,416,469 A * 5/1995 Colling ..... 340/573.5
5,559,497 A * 9/1996 Hong ..... 340/573.1
5,726,631 A * 3/1998 Lin ..... 340/573.1
5,923,258 A * 7/1999 Tseng ..... 340/584
5,973,602 A * 10/1999 Cole et al. ..... 340/584
6,078,262 A * 6/2000 Young ..... 340/584
6,122,537 A 9/2000 Schmidt ..... 600/407
6,208,286 B1 3/2001 Rostislavovich et al. .... 342/135
6,466,688 B1 10/2002 Ramstack ..... 382/128
6,909,397 B1 6/2005 Greneker, III et al. ..... 342/173
7,012,535 B2 * 3/2006 Keller ..... 340/581

OTHER PUBLICATIONS

Internet Research: Univ. of MN; Optomechanical Microsystems Group; Spectrally Tunable Infrared Detector Oct. 3, 2005.
Internet Research: PerkinElmer TPMI perkinelmer.com on thermopiles Oct. 3, 2005.

* cited by examiner

*Primary Examiner*—Davetta W. Goins
(74) *Attorney, Agent, or Firm*—Cislo & Thomas, LLP

(57) ABSTRACT

A heat sensor activated detector having a housing, which accommodates a heat sensor, a logic device that compares the heat signal read by the heat sensor to a predetermined level and transmits an enable signal to an audible signal generator where the heat signal is outside of the predetermined level, an audible signal generator, and a power source. The heat sensor may be tuned to the body heat of the user. Also, the predetermined level may be set to a specific distance, such as three meters. Further, the detector may be attached, temporarily or permanently, to an object the user wants to protect against loss or misplacement.

4 Claims, 2 Drawing Sheets

HEAT SENSOR ACTIVATED DETECTOR AND METHOD

CROSS-REFERENCES TO RELATED APPLICATIONS

This patent application is related to U.S. Patent Application Ser. No. 60/689,941 filed Jun. 14, 2005 for a Reminder Beeper, which application is incorporated herein by this reference.

BACKGROUND

1. Field of the Invention

This invention relates to devices employing heat sensors to detect when objects are lost or mislaid.

2. Description of the Related Art

Distractions are nearly impossible to avoid in today's fast paced world. It is common to lose or misplace personal objects while attending to so many tasks. Once things have calmed, many face an extended search for such objects. Searching for misplaced personal objects can be aggravating and time consuming. Therefore, there is a need for a way to notify the user when they are leaving a personal object behind. Further, there is a need to provide the user with a way to locate that misplaced object.

Previous inventions have relied on multiple devices to find lost objects: one device for the user and a second device for the object to be protected from loss. One object of the present invention is to provide a device for locating lost items or preventing items from being left behind which does not require a second device on the user. Another object of the present invention is to provide a device that uses the body heat of the user to signal when the user is about to leave an object behind.

SUMMARY

The embodiments disclosed herein are generally directed to a heat sensor activated detector and method of producing a heat sensor activated audible signal.

In one aspect of the invention, the heat sensor activated detector comprises a heat sensor, an audible signal generator, a logic device, a power source, and a housing. The logic device, or receiver circuit, receives the heat signal from the heat sensor, compares the heat signal to a predetermined level, and transmits an enable signal to the audible signal generator if the heat signal is outside of the predetermined level. The power source supplies power to the heat sensor, the audible signal generator, and the logic device. The housing contains the heat sensor, the audible signal generator, the logic device, and the power source.

In another aspect of the invention, the heat sensor is tuned to the body heat of the user.

In another aspect of the invention, the predetermined level is a distance of three meters.

In another aspect of the invention, the heat sensor activated detector can be attached, temporarily or permanently, to an object the user wants to protect against loss or misplacement. This means for attachment might be a hook-and-loop fastener, a snap closure, an adhesive, or any other means for permanently or temporarily connecting the heat sensor activated detector to another object.

In accordance with another aspect of the invention, a method of producing an audible signal comprises the steps of:

(a) monitoring a heat signal heat via a heat sensor;

(b) connecting the heat sensor to a logic device;

(c) connecting the logic device to an audible signal generator;

(d) generating an enable signal by the logic device to the audible signal generator when the monitored heat falls outside of a predetermined level; and (e) emitting an audible signal by the audible signal generator upon receipt of the enable signal.

In accordance with another aspect of the invention, the method of producing a heat sensor activated audible signal further comprises the step of affixing the heat sensor to an object.

These and other aspects of the invention will become apparent from a review of the accompanying drawings and the following detailed description of the invention.

DESCRIPTION

The detailed description set forth below in connection with the appended drawings is intended as a description of the presently-preferred embodiments of the invention and is not intended to represent the only forms in which the present invention may be constructed or utilized. The description sets forth the functions and the sequence of steps for constructing and operating the invention in connection with the is illustrated embodiments. However, it is to be understood that the same or equivalent functions and sequences may be accomplished by different embodiments that are also intended to be encompassed within the spirit and scope of the invention.

Figure 1:
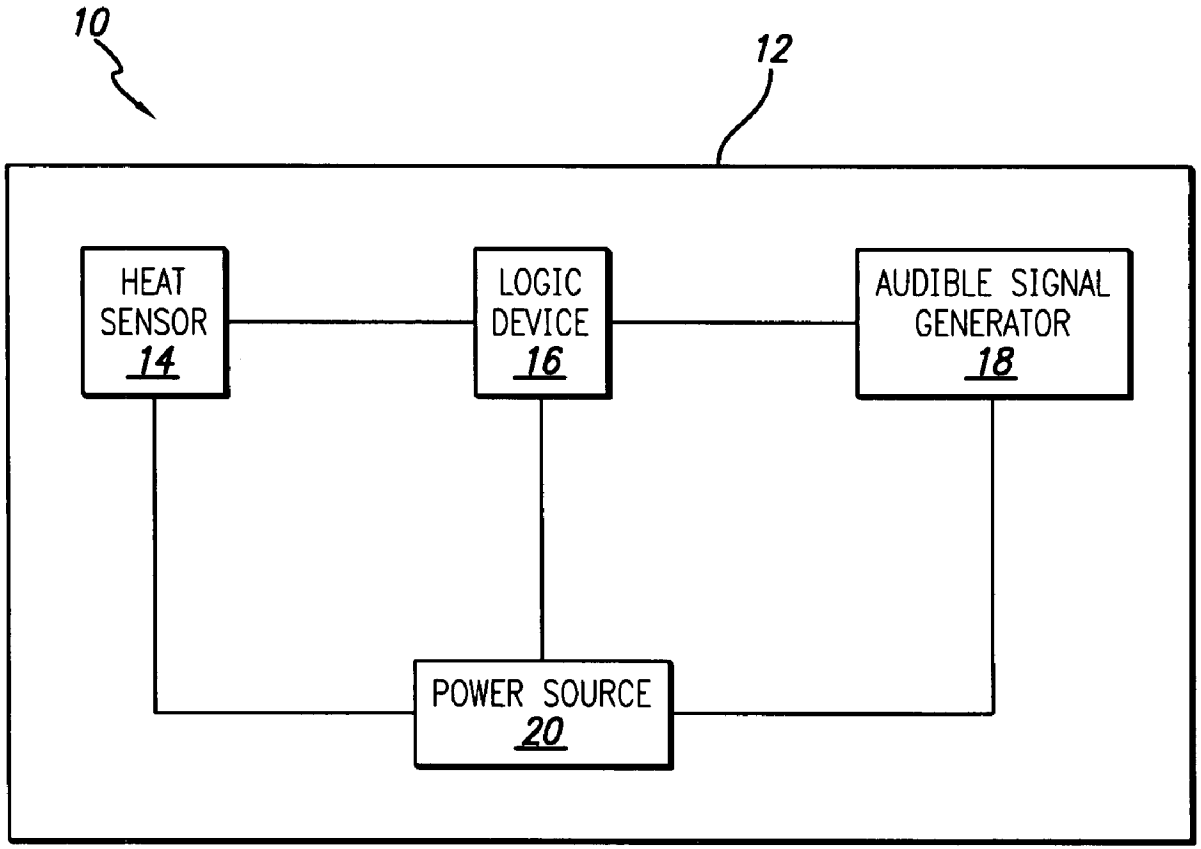
FIG. 1 is a schematic of one version the heat sensor activated detector.

FIG. 1 is a schematic of a heat sensor activated detector 10 in accordance with an embodiment of the present invention. The heat sensor activated detector 10 comprises a housing 12, which accommodates a heat sensor 14, a logic device 16, an audible signal generator 18, and a power source 20. The power source 20 may be a permanent battery, a replaceable battery, a wind-up generator, or a similar device.

Figure 2:
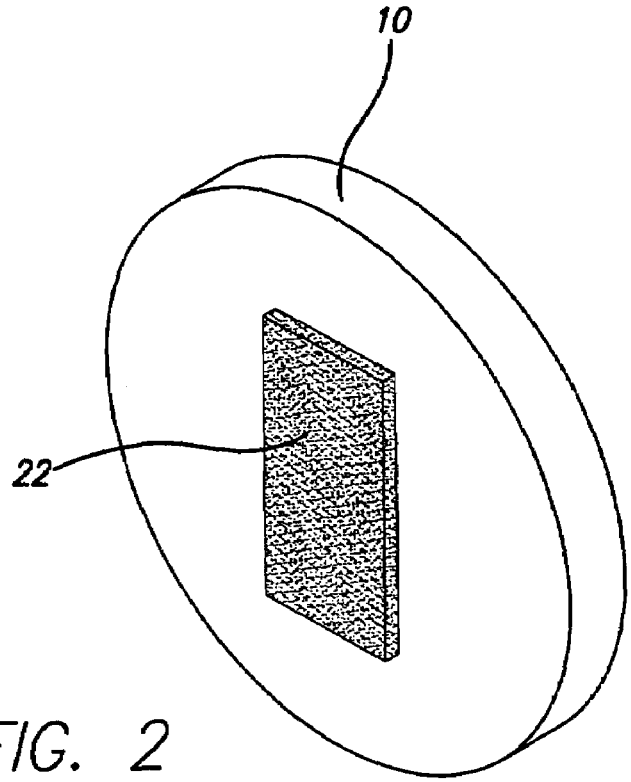
FIG. 2 is a perspective view of an embodiment having a means for attaching a heat sensor activated detector to other objects.

Further, the housing 12 may include a means for attachment 22, allowing the heat sensor activated detector 10 to be coupled with another object. This means for attachment 22 might be a hook-and-loop fastener, a snap closure, an adhesive, or any other means for permanently or temporarily connecting the heat sensor activated detector 10 to another object. This version of the invention is depicted in FIG. 2.

The heat sensor activated detector 10 is placed on, placed near, or attached to an object. The heat sensor 14 monitors a heat signal. In some versions of the invention, the heat sensor 14 is tunable. Tunable heat sensors are known in the art. For example, refer to U.S. Pat. No. 4,144,540. The heat signal monitored by the heat sensor 14 could be any heat source or sink that varies from ambient conditions. In one embodiment, this heat signal is the body heat of the user. The logic device 16, or receiver circuit, receives the heat signal from the heat sensor and compares the heat signal to a predetermined level. In a version of the invention, the predetermined level is the body heat of the user beyond a distance of three meters from the heat sensor 14. Where the heat signal differs from the predetermined level or range of levels, the logic device 16 permits a voltage to be applied to the audible signal generator

Figure 3:
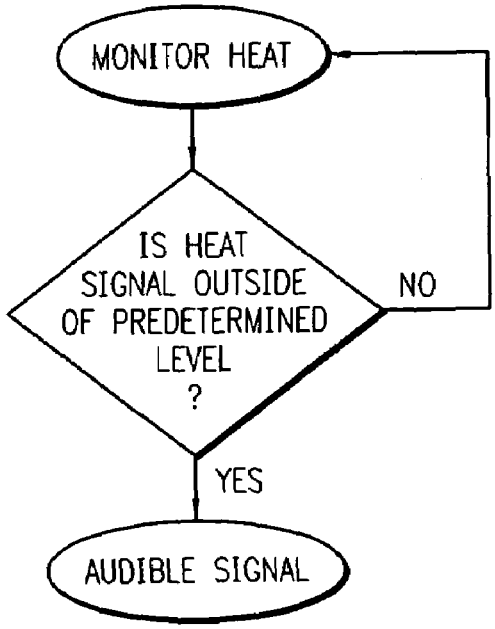
FIG. 3 is a schematic of the logic function of the heat sensor activated detector.

18. The audible signal generator 18 then emits a sound to alert the user. This process is shown schematically in FIG. 3. Emission of the sound permits the user both to take notice that the object is beyond the predetermined distance from the user and to locate the object.

While the present invention has been described with regards to particular embodiments, it is recognized that additional variations of the present invention may be devised without departing from the inventive concept.

What is claimed is:

1. A heat sensor activated detector comprising:

(a) a heat sensor that monitors a heat signal;

(b) an audible signal generator;

(c) a logic device that compares the heat signal to a predetermined level and transmits an enable signal to the audible signal generator if the heat signal is below the predetermined level, the predetermined level corresponding to a preset distance from a user, the user having a body heat;

(d) a power source that supplies power to the heat sensor, the audible signal generator, and the logic device;

(e) a housing that contains the heat sensor, the audible signal generator, the logic device, and the power source; and (f) a means for attaching the detector to another object, the means comprising a connector selected from the group consisting of a hook-and-loop fastener, a snap closure, and an adhesive, the other object being commonly a misplaced personal objects;

whereby the audible signal generator emits a sound upon receipt of the enable signal, the sound permitting the user to take notice that the other object is beyond the preset distance and to locate the other object.

2. The detector of claim 1 wherein the heat sensor is tunable to the body heat of the user.

3. The detector of claim 2 wherein the predetermined level is the body heat of the user beyond a distance of three meters.

4. A method of producing a heat sensor activated audible signal comprising the steps of:

(a) monitoring a heat signal heat via a heat sensor;

(b) connecting the heat sensor to a logic device;

(c) connecting the logic device to an audible signal generator;

(d) affixing the heat sensor to a commonly misplaced personal object by way of a hook-and-loop fastener, a snap closure, or an adhesive;

(e) generating an enable signal by the logic device to the audible signal generator when the monitored heat falls below a predetermined level, the predetermined level corresponding to a preset distance from a user; and (f) emitting an audible signal by the audible signal generator upon receipt of the enable signal, the audible signal permitting the user both to notice that the personal object is beyond the preset distance and to locate the personal object.

* * * * *